United States Patent [19]

Hobbs

[11] 4,272,970

[45] Jun. 16, 1981

[54] COMPRESSION REFRIGERATION SYSTEM

[76] Inventor: James R. Hobbs, 5303 Glenmont, Houston, Tex. 77081

[21] Appl. No.: 117,908

[22] Filed: Feb. 4, 1980

[51] Int. Cl.[3] ..... F25B 41/06

[52] U.S. Cl. ..... 62/511; 62/509; 62/513; 62/527

[58] Field of Search ..... 62/511, 527, 509, 513, 62/54

[56] References Cited

U.S. PATENT DOCUMENTS

| | | | |
|---|---|---|---|
| 1,873,519 | 8/1932 | Williams | 62/511 |
| 2,100,504 | 11/1937 | Crosley et al. | 62/511 |
| 2,393,854 | 1/1946 | Carpenter | 62/511 |
| 2,467,078 | 8/1949 | Cahenzli, Jr. | 62/511 |
| 2,520,045 | 8/1950 | McGrath | 62/511 |
| 2,685,780 | 8/1954 | Zearfoss, Jr. | 62/511 |
| 2,835,114 | 5/1958 | Shoemaker | 62/511 |
| 2,956,421 | 10/1960 | Stevens | 62/511 |
| 2,979,924 | 4/1961 | Balogh | 62/511 |
| 3,048,021 | 8/1962 | Coles et al. | 62/511 |
| 3,172,272 | 3/1965 | Alsing | 62/511 |
| 3,213,635 | 10/1965 | Jacobs | 62/511 |
| 3,311,131 | 3/1967 | Zahuranec | 62/511 |
| 3,681,936 | 8/1972 | Park | 62/511 |

*Primary Examiner*—Ronald C. Capossela
*Attorney, Agent, or Firm*—Fulbright & Jaworski

[57] ABSTRACT

A compression refrigeration system having a compressor, a condenser, an evaporator, and a liquid refrigerant in which a capillary tube is positioned within an enclosure. The liquid refrigerant from the condenser is connected to the enclosure inlet and then flows to the inlet of the capillary tube and out of the capillary tube to the evaporator, whereby the refrigerant in the enclosure forms a heat exchange relationship with the exterior of the capillary tube for providing a self-regulating flow through the capillary tube. Improved charging of the system is provided by positioning the inlet to the capillary tube above the bottom of the enclosure and providing a refrigeration adding valve to the enclosure to insure that the enclosure is filled to a predetermined level in order to enter the capillary tube. Preferably, a reserve of liquid refrigerant is inserted into the enclosure above the capillary inlet for compensating for variations in density of the refrigerant. Preferably, the outlet of the capillary tube is positioned above the inlet to the capillary tube to aid in charging of the system in the field by allowing the enclosure to be filled with the proper amount of refrigerant by tilting the enclosure to a proper angle in accordance with the operating variables while filling the enclosure with refrigerant. Preferably, it is desired that the capillary inlet be at the top of the capillary coil and the capillary outlet be above the capillary inlet.

11 Claims, 4 Drawing Figures

FIG. 1
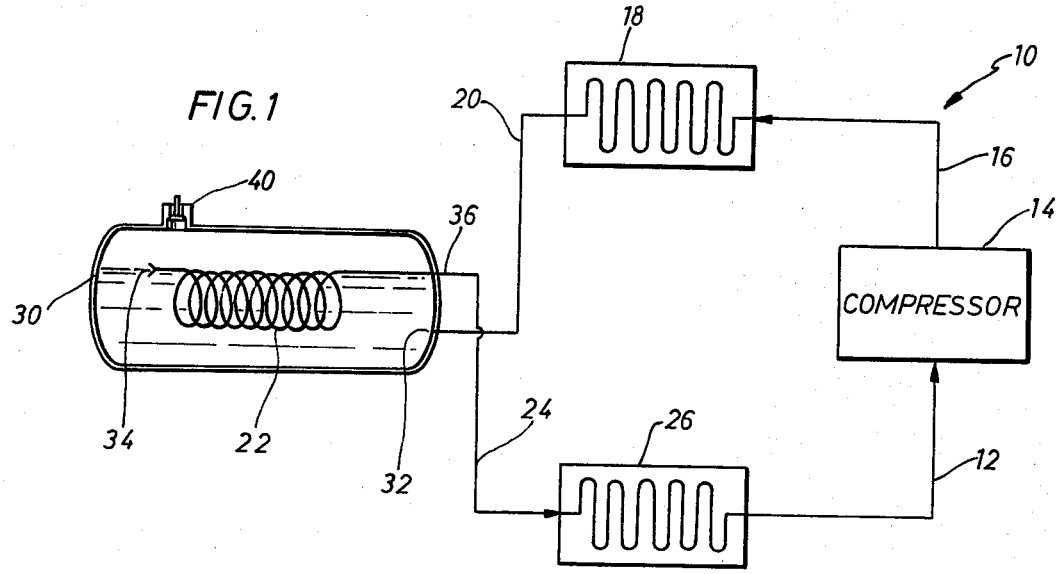
FIG. 2
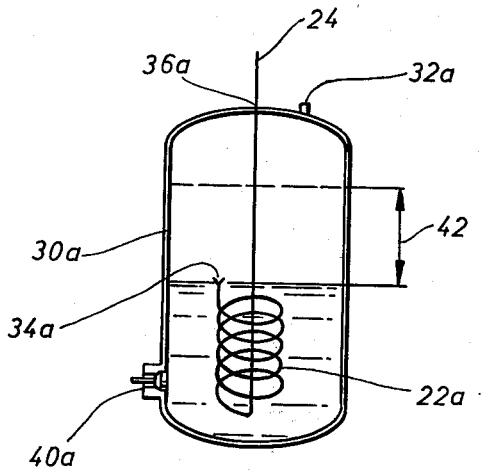
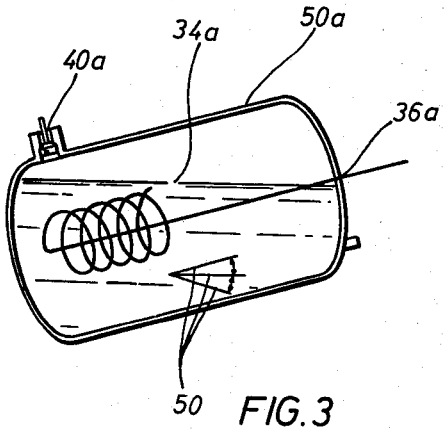
FIG. 3
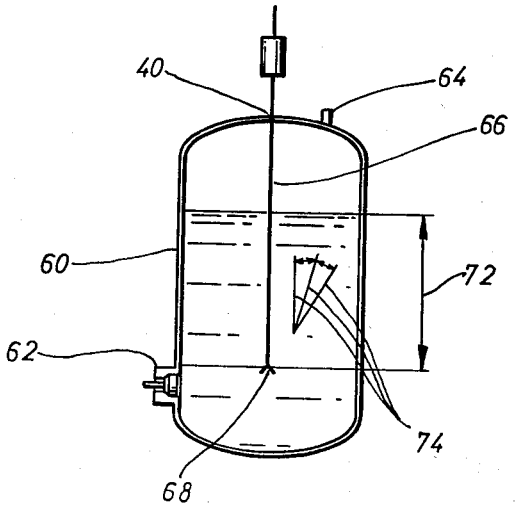
FIG. 4

COMPRESSION REFRIGERATION SYSTEM

BACKGROUND OF THE INVENTION

A conventional compression refrigeration system such as air conditioning generally includes a compressor which compresses a vapor refrigerant to a high pressure and high temperature, a condenser which removes the latent heat of condensation causing the gas to condense to a liquid, a capillary tube which provides a restriction for reducing the pressure, and an evaporator which absorbs heat from the medium to be cooled thereby causing the liquid refrigerant to evaporate back into a gas.

The capillary tube has the advantage of being inexpensive, but has the disadvantage of being fixed. That is, the outlet pressure from the capillary tube is a function of the inlet pressure. In systems using air as the condensing medium, and to a lesser extent in those systems which use water, the temperature of the condenser varies as the temperature of the condensing medium varies. For example, on hot afternoons, the condenser temperature and thus its pressure increases thereby increasing the pressure to the inlet of the capillary tube, increasing the temperature and pressure from the outlet of the capillary tube causing refrigerant gas going to the compressor to be at a higher pressure and therefore more dense and causing the compressor to pump more pounds of refrigerant thereby further increasing the condenser pressure and further compounding the build up of pressure problem. One of the features of the present invention is the provision of an improvement for self regulating the refrigerant flow through the capillary tube for overcoming the buildup of the pressure cycle by means of the heat exchange from hot liquid to flash gas. Otherwise, carried to its extreme conclusion, pressure cycle buildup will cause loss of efficiency, overloaded equipment, safety trip outs and equipment failures.

Another problem with conventional systems is that while the system can be satisfactorily charged with refrigerant under factory conditions, it is difficult under field conditions to obtain an accurate charging of the refrigeration system with the refrigerant. Another feature of the present invention is the provision of an improvement in a refrigeration system which allows service personnel to more accurately charge the refrigeration system in the field with the correct amount of refrigerant.

Another problem with conventional systems is to provide compensation for refrigerant density which is dependent upon several variables. The present invention provides an improved system for establishing and storing a reserve capacity of refrigerant in the system and an improved means for allowing the service personnel to determine the amount of the reserve refrigerant which should be placed in the system.

SUMMARY

One feature of the present invention is the improvement in a compression refrigeration system having a compressor, a condenser, an evaporator, a liquid refrigerant, and a capillary tube in which the restriction to flow through the capillary tube increases as the pressure drop across the capillary tube increases thereby providing a more stable evaporator temperature. The capillary tube is positioned in an enclosure and the warm liquid refrigerant coming from the condenser flows into the enclosure in a heat exchange relationship with the capillary tube, enters the capillary tube, and flows to the evaporator. The liquid refrigerant, when hotter, tends to cause more refrigerant in the capillary tube to boil and flash into gas thereby restricting the flow through the capillary tube and resulting in a larger pressure drop than when the liquid is cooler providing a trend toward self-regulating flow through the capillary tube.

A further object of the present invention is the improvement in a restriction between the condenser and evaporator of a capillary tube with an inlet and an outlet, an enclosure surrounding the capillary tube, the outlet of the capillary tube extending through the enclosure and connected to the inlet of the evaporator and the inlet of the capillary tube being in fluid communication with the interior of the enclosure. The enclosure has an inlet connected to the outlet of the condenser for receiving liquid refrigerant from the condenser which is placed in a heat exchange relationship with the exterior of the capillary tube and also flows into the capillary tube inlet for regulating the flow through the capillary tube.

Still a further object of the present invention is the provision of positioning of the inlet of the capillary tube at a predetermined distance above the bottom of the enclosure for aiding in correctly charging the system with refrigerant. Preferably, the liquid level of the refrigerant in the enclosure is above the inlet of the capillary tube to provide a reserve capacity of refrigerant. In addition, a refrigerant adding valve is connected to the enclosure for adding refrigerant to the enclosure.

Still a further object of the present invention is the provision of the enclosure inlet and the outlet of the capillary tube being adjacent to each other for increased heat exchange.

Still a further object of the present invention is the provision of positioning the inlet of the capillary tube at the top of a coil and positioning the outlet of the capillary tube above the inlet of the capillary tube. Thus the enclosure may be positioned at various angles for aiding in properly filling the enclosure with refrigerant until the refrigerant flows from the capillary tube outlet.

Yet a further object of the present invention is the provision of an improved system for storing a reserve capacity of refrigerant in an air conditioning system to compensate for the differences in the density of the gas in the system by providing an enclosure having an inlet and an outlet, the inlet being connected to the outlet of the condenser, the outlet being in communication with the inlet of the evaporator. A flow tube is positioned in the enclosure having an inlet in communication with the interior of the enclosure and the outlet of the flow tube being connected to the enclosure outlet. The inlet of the flow tube is positioned above the bottom of the enclosure and the outlet of the tube is positioned above the inlet whereby the enclosure can be filled with the proper amount of refrigerant by tilting the enclosure to a predetermined angle while filling until the refrigerant comes out of the outlet.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 1 is a schematic diagram of a compressor refrigeration system including one form of the present invention utilizing a self-regulating restriction, FIG. 2 is an elevational view of the preferred embodiment of the present invention providing a self-regulating restriction, and refrigerant charging aid device, FIG. 3 is an elevational view of the apparatus in FIG. 2 shown in a tilted position for aiding in properly charging the refrigeration system, and FIG. 4 is an elevational view of a charging device for use in a refrigeration system.

BRIEF DESCRIPTION OF THE PREFERRED EMBODIMENT

Referring now to FIG. 1, the schematic of a compression system for refrigeration, such as for air conditioning, is generally indicated by the reference numeral 10. As is conventional, the vapor of the refrigerant, which may be freon, in line 12 is compressed by the compressor 14 into line 16 at a high pressure and temperature such that the liquefaction temperature is above that of the atmospheric air or other coolant. From the compressor 14, the refrigerant goes to a liquefying condenser 18 where the heat of condensation is removed by air or cooling water causing the gas to condense to a liquid and passes through line 20. The now liquid refrigerant passes through a restriction such as a capilllary tube 22 which separates the high pressure region from the low pressure region as the capillary tube reduces the pressure as it passes to line 24. The evaporator 26 absorbs heat from the medium to be cooled and the liquid refrigerant evaporates back into a gas and completes the cycle by returning to line 12. The capillary tube 22 has the advantage of being inexpensive but has the disadvantage of being fixed as compared to an expansion valve. Therefore the outlet pressure in line 24 is a function of the inlet pressure in line 20 to the capillary tube 22. This creates severe problems as the discharge pressure and temperature in line 20 from the condenser 18 varies widely as the temperature of the condensing medium, and particularly air, varies.

Since the capillary tube is a fixed device, an increase in the pressure in line 20 will cause more refrigerant to pass through the capillary tube 22 which causes the following undesirable results:

(1) An increase in the outlet pressure from the capillary tube 22 and a corresponding increase in temperature, (2) An increase in the density of the gas in the low pressure side of the system in the line 22 and evaporator 26 further reducing the high pressure liquid available, and (3) An increase in the low side pressure in line 12 which causes the compressor 14 to handle more pounds of gas with each stroke thereby further elevating the pressure on the high side beginning in line 16. Therefore the cycle accentuates itself, that is, an increase in high side pressure 16 increases the low side pressure which further increases the high side pressure.

Referring now to FIG. 1, the present invention is directed to providing an enclosure 30 about the capillary tube 22. The enclosure 30 includes an inlet 32 connected to the line 20 and thus connected to the outlet of the condenser 18 for receiving liquid refrigerant from the condenser 18. The capillary tube 22 includes an inlet 34 in communication with the interior of the enclosure 30 for receiving the liquid refrigerant returning from the condenser 18 and an outlet 36 connected to line 24 and thus connected to the inlet of the evaporator 26. The capillary tube 22 functions to reduce the pressure from the high pressure side to the low pressure side of the system 10. As the refrigerant passes through the capillary tube 22 a portion of the refrigerant vaporizes as the pressure reduces thereby causing a refrigerating effect on the remaining liquid refrigerant and lowering its temperature. The refrigerant entering the inlet 32 of the enclosure 30 is in a heat exchange relationship with the exterior of the capillary tube 22, which is preferably helically wound, therefore, on hot days when the temperature and pressure of the incoming refrigerant in the enclosure 30 is greater, the refrigerant entering the enclosure 30 tends to cause the refrigerant in the capillary tube 22 to boil and flash into gas thereby restricting the flow through the capillary tube 22 resulting in a larger pressure drop than when the incoming refrigerant into the enclosure 30 is cooler. Therefore, the present system compensates as the temperature of the condensing medium, either air or water, over the condenser 18 varies. That is, in the event of increased pressure and higher temperatures in the condenser 18 and line 20, there is an increased heat exchange between the high temperature liquid inside of the enclosure 30 and the low pressure and flash gas vapor in the capillary tube 22 which causes an increase of gas in the capillary 22 resulting in a greater pressure drop across the capillary tube 22 which tends to compensate for the higher pressure and temperatures in the line 20. Thus, the present system provides a self-regulating flow through the capillary tube in the face of varying ambient conditions.

One conventional method of attempting to overcome the problem of increased flow through the capillary tube upon an increase of pressure and temperature is to limit the amount of refrigerant in a system to a "critical charge". In this method only a given amount of refrigerant is placed in the system such that the amount of liquid available at the capillary tube 34 would be less than 100% to break up the buildup of pressure cycles. This is inefficient as it requires expenditure of energy for no other purpose than to limit a system from malfunctioning. However, in the present system the heat from the warm refrigerant in the enclosure 30 heats the mixture of cooler liquid and flash gas in the capillary tube 22 causing more flash gas to be developed and in turn causing a greater restriction through the tube 22 which further causes more flash gas to be developed. But also, the heat which comes out of the warm liquid in the enclosure 30 tends to subcool that liquid prior to entering the capillary tube 22 and therefore less flash gas is required to effect the desired pressure reduction. The net result is that a higher quality of liquid is available for passage to the evaporator 26 than is possible under the "critical charge" method.

Preferably, the inlet 32 of the enclosure 30 is adjacent to the outlet 36 of the capillary tube to provide an increased heat relationship between the refrigerant in the enclosure 30 and the capillary tube 22.

Another problem encountered in refrigeration systems is the problem of accurately and correctly charging the system with the proper amount of refrigerant. Another feature of the present invention is to improve the charging methods used in the field. Thus, the inlet 34 of the capillary tube 22 is positioned a predetermined distance above the bottom of the enclosure 30 thereby requiring that the refrigerant level in the enclosure level be sufficient to enter the capillary tube 22. Service personnel can quickly detect if the refrigerant level has reached the inlet 34 of the capillary 22 by feeling the temperature of the capillary tube outlet 36. The temperature will be warm if the liquid level of the refrigerant in the enclosure 30 is below the inlet 34 and will be cold when the liquid level in the enclosure 30 is at or above the inlet 34. In addition, the service personnel can also determine by the sound of the fluid passing through the capillarly 22 whether or not the liquid level is sufficiently high. While other portions of the system 10 may have inlets for charging refrigerant into the system 10, it is desirable to provide a refrigerant adding valve 40 such as a conventional Schrader valve or needle valve to facilitate the adding of refrigerant at this more desirable point in the system 10.

Another feature of the present invention is the provision of a reserve capacity of refrigerant in the system to compensate for differences in density of the gas in the system. While the apparatus of FIG. 1 could be utilized by inserting an extra amount of liquid refrigerant into the enclosure 30 above the capillary tube 22, the preferred embodiment is best seen in FIG. 2 which is generally similar to the apparatus shown in FIG. 1 except in an upright or vertical position and in which like parts are designated by like numbers with the suffix "a". In FIG. 2 the liquid refrigerant in the enclosure **30*a* has a reserve capacity equal to the distance 42 above the inlet 34*a* of the capillary tube 22*a* which serves as a small reservoir refrigerant available to compensate for the variations in the density of the refrigerant. However, the amount of the reserve capacity 42 as well as the amount of the charge of refrigerant in the system 10 depends upon several variables which may include the ambient temperature, size and length of the lines, and design efficiency. The present invention is particularly applicable to assisting the service man by providing a more accurate method of charging a system and providing for the desired reserve capacity. That is, the volume inside of the enclosure 30 is known. And by placing the enclosure 30*a* in a tilted position as best seen in FIG. 3, the volume below the inlet 34*a* and the outlet 36*a* will vary with the angle at which the enclosure 30*a* is set relative to horizontal. Therefore, the volume of liquid refrigerant placed in the enclosure 30*a* through the valve 40*a* and filling the space below the dotted line 50 before the liquid flows out of the outlet 36*a* will be determined by the angle from horizontal that the container 30*a* is set while filling. Thus, a suitable charging chart can be provided with emperical values based upon the measured variables to determine the angle at which the container 30*a* should be set. In addition, suitable indicating lines 50 can be placed upon the exterior 30*a* to aid the service personnel in tilting the container 30*a*** to the proper angle for filling.

While the feature of properly charging the enclosures 30 and **30*a* are particularly applicable for use in combination with the temperature compensation of the capillary tubes 22 and 22*a*, the structure of improving the accuracy of charging an air conditioning system 10 in the field by a service man may be utilized independently of a capillary tube system. Referring now to FIG. 4, an enclosure 60 is provided having a refrigerant adding valve 62 and an inlet 64 which is connected to and receives liquid refrigerant from a condenser. An unrestricted flow line 66 is positioned in the enclosure 60 having a fluid inlet 68 positioned above the bottom of the enclosure 60 and an outlet 70 which may be connected to any suitable restriction such as an orifice, or an expansion valve. The enclosure 60 is suitable for allowing a service man to accurately charge a refrigeration system with the correct amount of refrigerant and provide a reserve capacity indicated by the level 72 above the inlet 68. The enclosure 60 is charged similarly to the charging of the container 30*a* as described in connection with FIGS. 2 and 3 by tilting the enclosure 60 to an angle from the horizontal as determined by indicating lines 74 which are determined by an emperical charging chart based upon the known variables and thereafter the enclosure 60 is placed in the upright position as shown in FIG. 4**.

It should be noted that while the reserve capacity of refrigerant in the system will increase the efficiency of the system by increasing the quality of liquid refrigerant going into the evaporator, the safety feature of a limited charge is maintained, and even enhanced by having a more accurate means of charging the system with only a small amount of reserve refrigerant.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will readily suggest themselves to those skilled in the art and which are encompassed within the spirit of the invention and the scope of the appended claims.

What is claimed is:

1. In a compression refrigeration system having a compressor, a condenser, an evaporator and a liquid refrigerant, the improvement in a restriction between the condenser and the evaporator comprising, a capillary tube having an inlet and an outlet, an enclosure surrounding the capillary tube, the outlet of the capillary tube extending through the enclosure and connected to the inlet of the evaporator, the inlet of the capillary tube being in fluid communication with the interior of the enclosure, said enclosure having an inlet connected to the outlet of the condenser for receiving liquid refrigerant from the condenser which flows into the capillary tube inlet and also forms a heat exchange with the exterior of the capillary tube for providing a self-regulating flow through the capillary tube.

2. The apparatus of claim 1 including, a refrigerant adding valve connected to the enclosure for adding refrigerant.

3. The apparatus of claim 1 or 2 wherein, the inlet of the capillary tube is in communication with the interior of the enclosure at a predetermined distance above the bottom of the enclosure for aiding in correctly charging the system with refrigerant.

4. The apparatus of claim 1 wherein, the liquid level of refrigerant in the enclosure is above the inlet of the capillary tube.

5. The apparatus of claim 1 wherein, the enclosure inlet and the outlet of capillary tube are adjacent each other for increased heat exchange.

6. The apparatus of claim 1 wherein, the capillary tube is helical wound.

7. In a compression refrigeration system having a compressor, a condenser, an evaporator, and a liquid refrigerant, the improvement in a restriction between the condenser and the evaporator comprising, a helically wound capillary tube coil having an inlet and an outlet, an enclosure surrounding the capillary tube, the outlet of the capillary tube extending through the enclosure and connected to the inlet of the evaporator, the inlet of the capillary tube being in communication with the interior of the enclosure at a predetermined distance above the bottom of the enclosure for aiding in correctly charging the system with refrigerant, liquid refrigerant positioned in the enclosure and extending above the inlet of the capillary tube, said enclosure having an inlet connected to the outlet of the condenser for receiving liquid refrigerant from the condenser which flows into the capillary tube inlet and forms a heat exchange with the exterior of the capillary tube for providing a self-regulating flow through the capillary tube.

8. The apparatus of claim 7 including, a refrigerant adding valve connected to the enclosure for adding refrigerant.

9. The apparatus of claim 7 wherein, the inlet of the capillary tube is positioned at the top of the helically wound coil.

10. The apparatus of claim 8 including, a plurality of indicating lines on the exterior of the enclosure extending at various angles for adding in properly filling the enclosure with refrigerant by tilting the enclosure to the proper angle while filling.

11. In a compression refrigeration system having a compressor, a condenser, an evaporator, and a liquid refrigerant, the improvement in a refrigerant density compensator comprising, an enclosure having an inlet and an outlet, the inlet being connected to the outlet of the condenser, an outlet in communication with the inlet of the evaporator, a flow tube having an inlet and an outlet, the inlet being in fluid communication with the interior of the enclosure and the outlet being connected to the enclosure outlet, the inlet of the flow tube being positioned above the bottom of the enclosure, the outlet being positioned above the inlet whereby the enclosure can be filled with the proper amount of refrigerant by tilting the enclosure to a predetermined angle while filling.

* * * * *